United States Patent [19]

Roiko

[11] 4,110,896

[45] Sep. 5, 1978

[54] CABLE CONNECTING STATION

[75] Inventor: Russell A. Roiko, Osseo, Minn.

[73] Assignee: Minnesota Mining and Manufacturing Company, St. Paul, Minn.

[21] Appl. No.: 830,853

[22] Filed: Sep. 6, 1977

Related U.S. Application Data

[63] Continuation-in-part of Ser. No. 735,172, Oct. 26, 1976, abandoned.

[51] Int. Cl.[2] ..... H01R 43/04

[52] U.S. Cl. ..... 29/566.3; 29/749; 29/751

[58] Field of Search ..... 29/566.3, 566.4, 749, 29/750, 751, 753

[56] References Cited

U.S. PATENT DOCUMENTS

| | | | |
|---|---|---|---|
| 3,886,641 | 6/1975 | Davis | 29/749 X |
| 3,953,916 | 5/1976 | Rolland et al. | 29/566.3 |
| 3,965,558 | 6/1976 | McKee | 29/749 |
| 3,972,101 | 8/1976 | Casey et al. | 29/749 |
| 4,020,540 | 5/1977 | Casciotti et al. | 29/749 |
| 4,047,294 | 9/1977 | Quigley | 29/749 |

*Primary Examiner*—Carl E. Hall

*Attorney, Agent, or Firm*—Cruzan Alexander; Donald M. Sell; Temple Clayton

[57] ABSTRACT

A cable connecting apparatus for locking of wires of a multipair cable in a cable connector comprises a base with longitudinal axis, a connector receiving station and a cable receiving station having supply side and product side and having first and second comb means on respective sides, means in the base for elevating the cable receiving station and rotatable arm means containing an anvil means, the arm means rotating about the axis of the base into a position above the cable connecting station.

7 Claims, 16 Drawing Figures

CABLE CONNECTING STATION

This apparatus is a continuation-in-part of my copending application Ser. No. 735,172, filed Oct. 26, 1976, now abandoned.

This invention relates to a cable connecting station and apparatus for actuating the locking action of wire connectors and particularly multiwire connectors of multiple pair cables. In some embodiments the cable is continuous with several connectors and in other embodiments the cable is terminated with the mounting of a connector.

In U.S. Ser. Nos. 639,219 and 630,220, filed on Nov. 10, 1975, and assigned to the Assignee of the present application, are described connectors for multipair cable terminations having wire stripping contact elements. The connectors are in both male and female forms having respectively a central rib and central recess. In each case the connector comprises a body having multiple contact elements in parallel wire channels to which wires of the cable are connected, and a cover which engages the body and assures secure connection of each wire to the correct contact member. The connectors are particularly of use with telephone cables which in United States practice are regularly 25 pairs of 24 or 26 AWG (American Wire Gauge) wire. In using these connectors or cable terminations, wires are loosely attached to each of the 50 contact members and then secured by urging the cover into engaging position while cutting away end portions of the several wires.

It is a principal object of this invention to provide apparatus for locking connections and clipping wire ends in producing cable terminations. A further object of this invention is to provide apparatus for attaching cable connectors to multipair cables. Other objects will be evident elsewhere herein.

An apparatus is now provided, adaptable to either male or female connectors, having means for temporary retention of separate pairs of a multipair cable in connective relationship to a single connector body and substantially simultaneously urging the cover of said connector into interlocking relationship thereto and in suitable cases cutting off wire ends at the edge of said connector. In broad terms apparatus of the invention for attachment of connectors to a multipair cable comprises a base having a longitudinal axis, a connector receiving station on the base having supply side and product side and comprising a receptacle for a connector, first comb means on one side of said station for positioning and indexing pairs of wires in the multipair cable and second comb means on the other side of the station for retaining individual wires of the pairs transverse of the station, means in the base for elevating the connector receiving station with respect to the base, and arm means rotatable about the axis of the base from a horizontal position to a position immediately above the connector receiving station and comprising anvil means positioned to contact a connector in the receptacle of the connector receiving station when the connector's cover is in position and the connector receiving station is elevated.

Elevation of the connector receiving station may be by any convenient means. In one embodiment of the invention manually or mechanically operated cams in the base are brought into action against plungers on the under side of the connector receiving station. In another embodiment plungers or pistons on the under side of the connector receiving station are actuated pneumatically by compressed air or hydraulically by water or oil.

In certain embodiments of the invention cable arresting or retaining means are provided by any convenient type for temporarily attaching a multipair cable to one side of the connector receiving station and retaining it there during the attachment of the connector. A simple clip may be satisfactory or a locking lever may be employed. In a preferred cable retaining means alternative positions are employed for optimum orientation of the cable when male or female connectors are being attached.

The receptacle of the connector receiving station is conveniently positioned on posts in a channel in the connector receiving station, the posts being of different diameters and the receptacle being hermaphroditic in that it adapts by reversal of both male and female connectors. Receptacles of different sizes may be employed for connectors of different sizes.

The first comb means is conveniently composed of a series of shaped flat teeth in sequence and suitably color coded to distinguish or index particular sets of pairs of wires in a multipair cable. In one embodiment the first comb means is mounted on a frame which engages slidably with the side of the connector receiving station. For 25 pair cable the first comb means comprises 25 teeth. For other cables first comb means possessing more or fewer teeth can be provided. The second comb means is conveniently a coil of wire the spaces between consecutive helices being of the necessary width to receive and hold insulated wire of the size in the cable. For use with various gauges wire multiple wire second comb means may be provided, holding, for example 28 gauge wire in one size coil and 24 or 26 gauge in another or a single coil with helix spacing adjustable.

The arm means is conveniently a U-shaped piece with suitably shaped anvil means which in some embodiments includes a knife blade mounted on it. It conveniently includes indexing means such as click stops to position it correctly over the connector receiving station and desirably the anvil means or crimping bar is profiled to engage the cover or lid of the connector and thereby also, in suitable embodiments, orienting the knife blade to cut wire ends substantially flush at the side of the connector. In other embodiments cut-off blades may be included as part of the connector base or lid. It may also be desirable to attach several connectors to a length of cable without cutting the wires.

The invention is further described by reference to the drawings wherein

Figure 1:
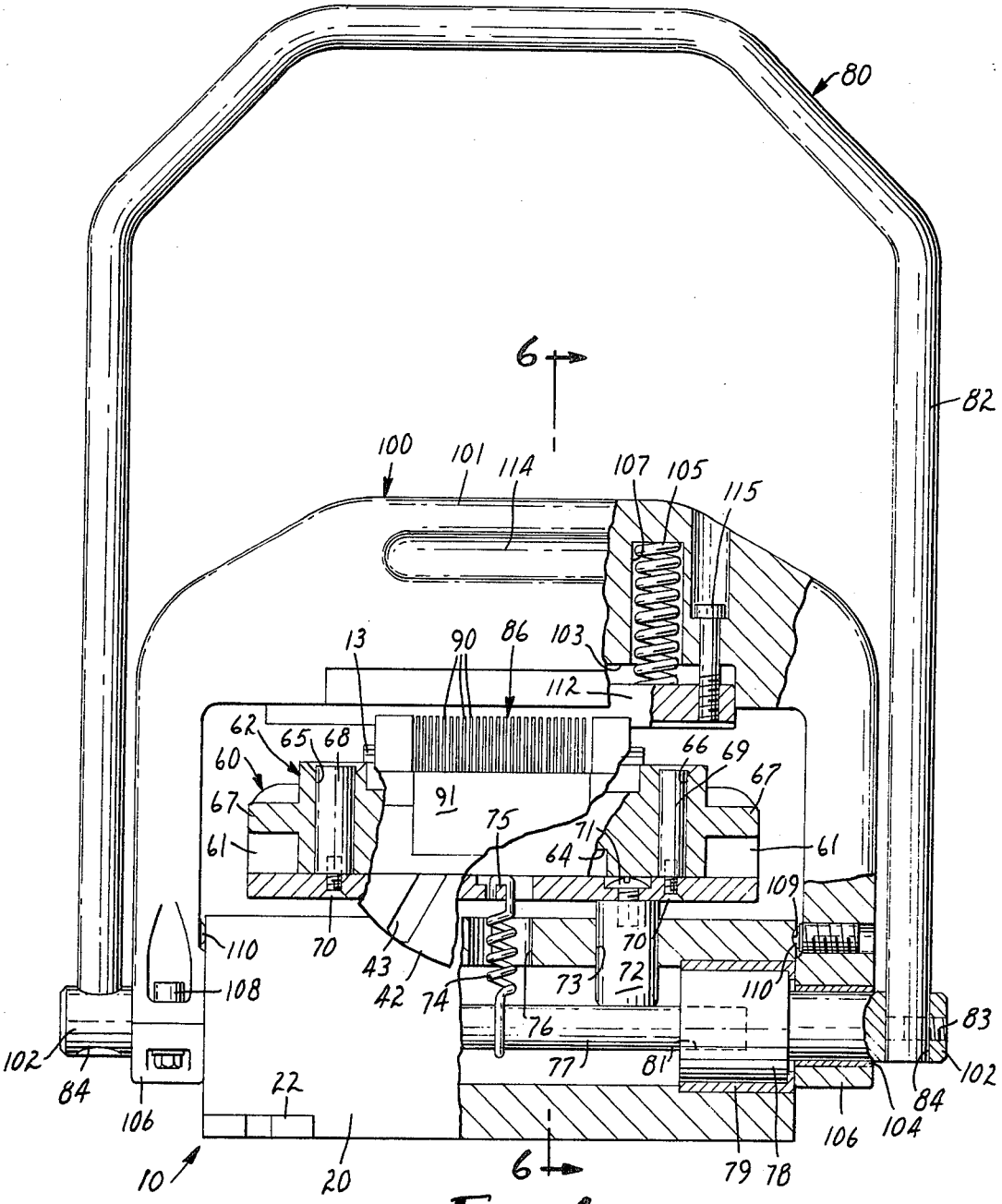
FIG. 1 is a front elevation view of one embodiment of the multipair cable connecting apparatus of the invention in an intermediate position of the relatively movable parts shown from the supply side of the connector receiving station.
Figure 2:
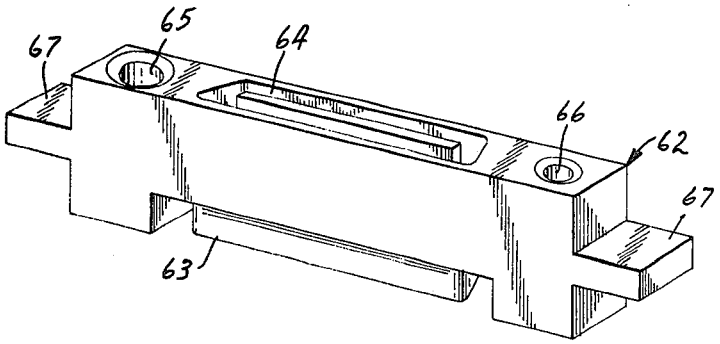
FIG. 2 is a perspective view of a reversible connector receptacle used in the apparatus of the invention.
Figure 4:
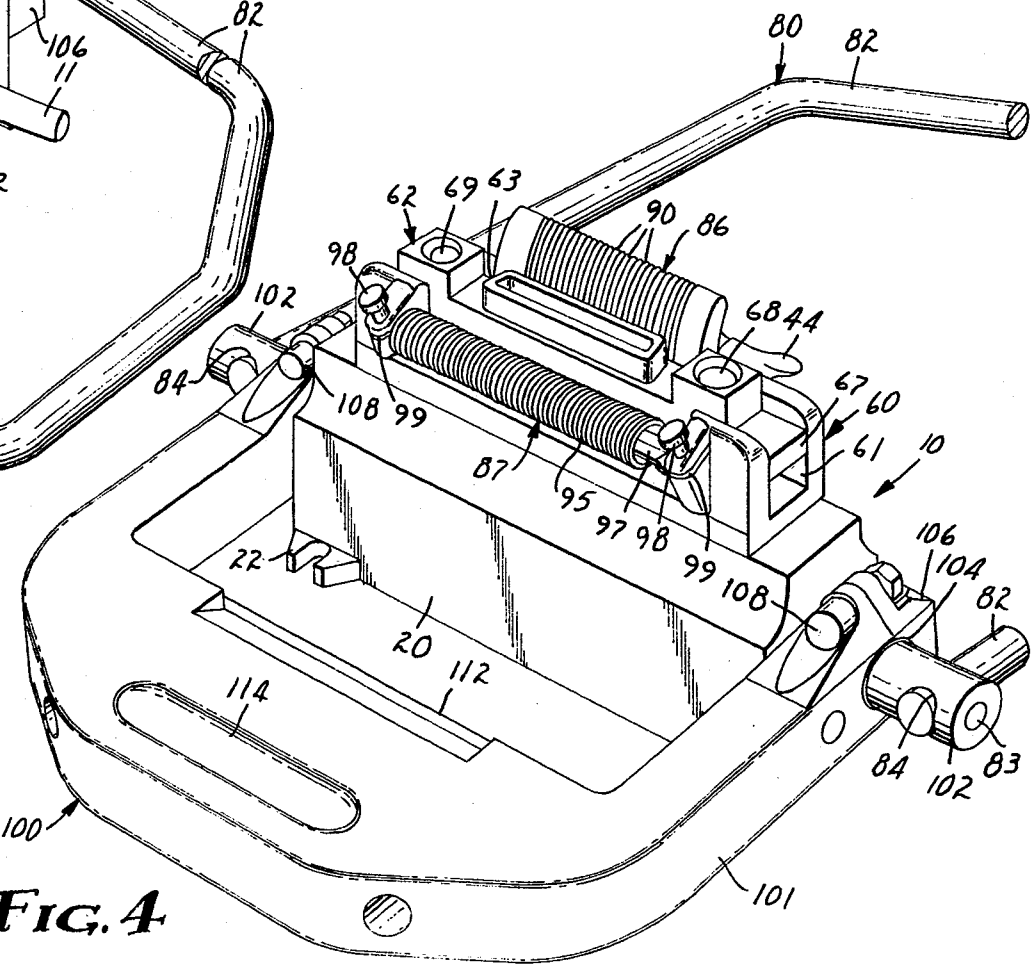
FIG. 4 is a perspective rear (product side) view corresponding to the front view of FIG. 3.
Figure 3:
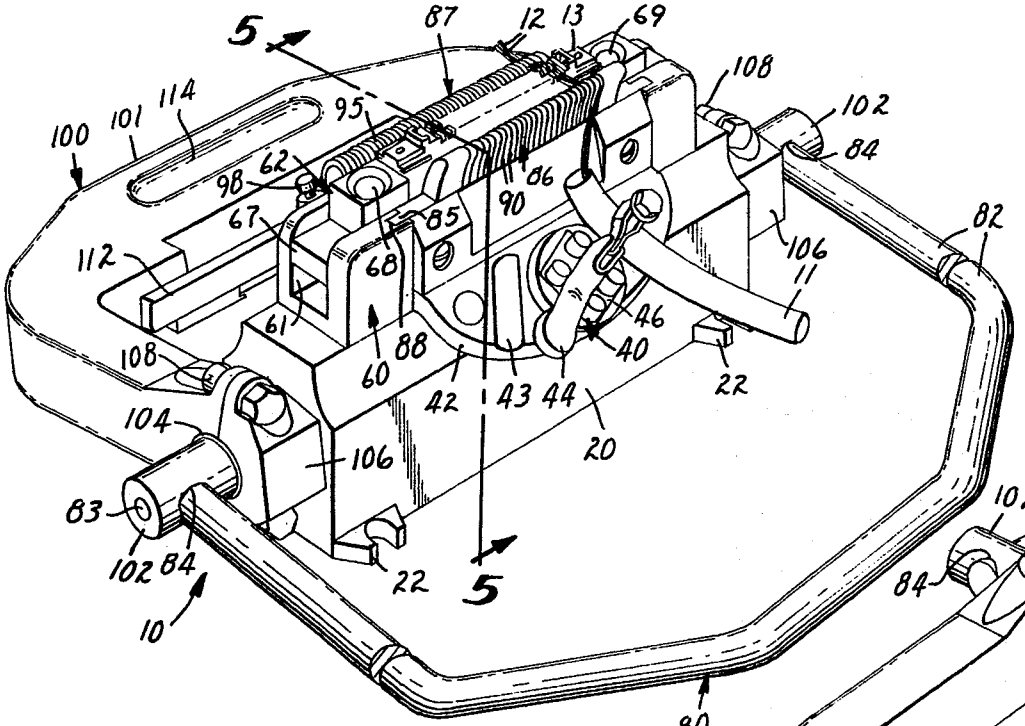
FIG. 3 is a perspective view of the front (supply side) of the embodiment of FIG. 1 in an open position.
Figure 5:
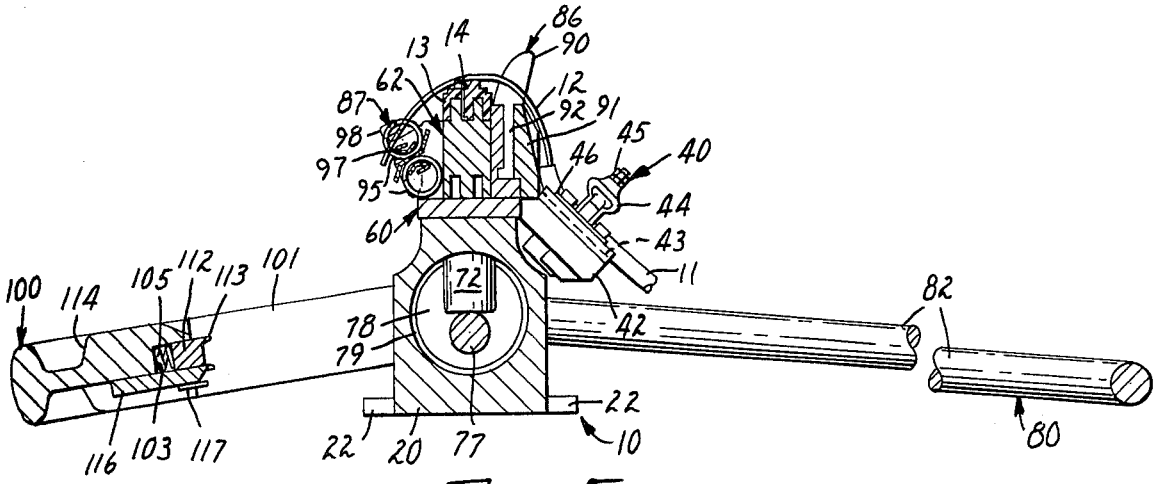
FIG. 5 is a sectional view taken along line 5—5 of FIG. 3 showing a cable in position and female connector part in the receptacle with movable parts in open position.
Figure 6:
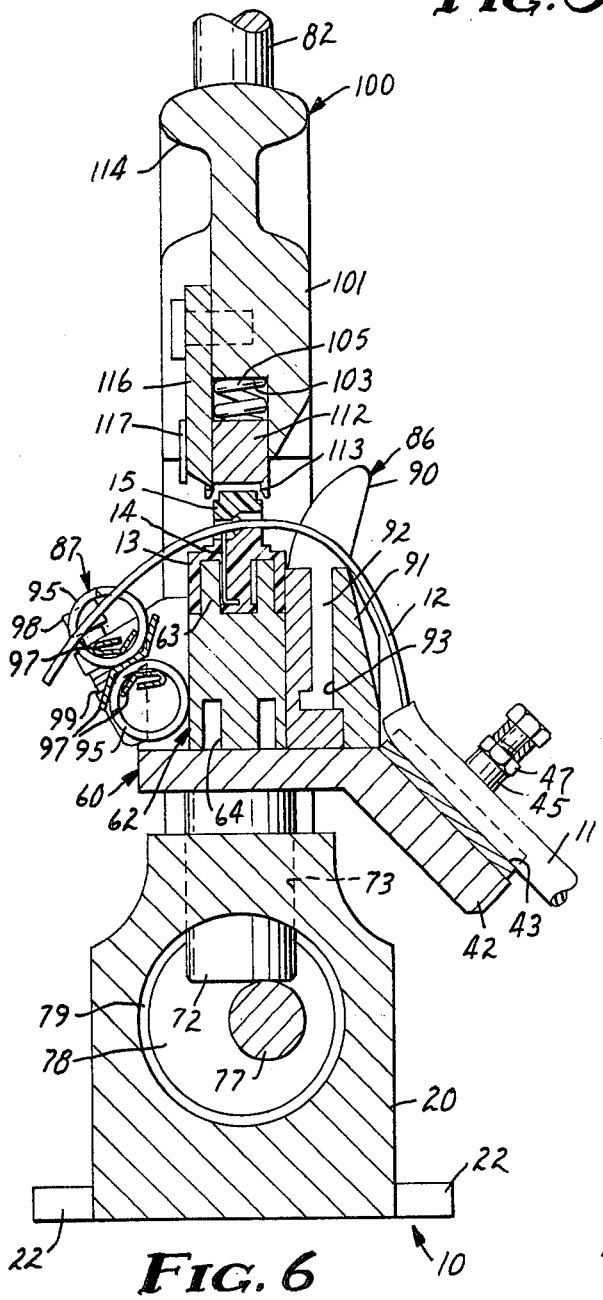
FIG. 6 is an enlarged sectional view taken along line 6—6 of FIG. 1 with movable parts in an intermediate position and wires partly connected.
Figure 7:
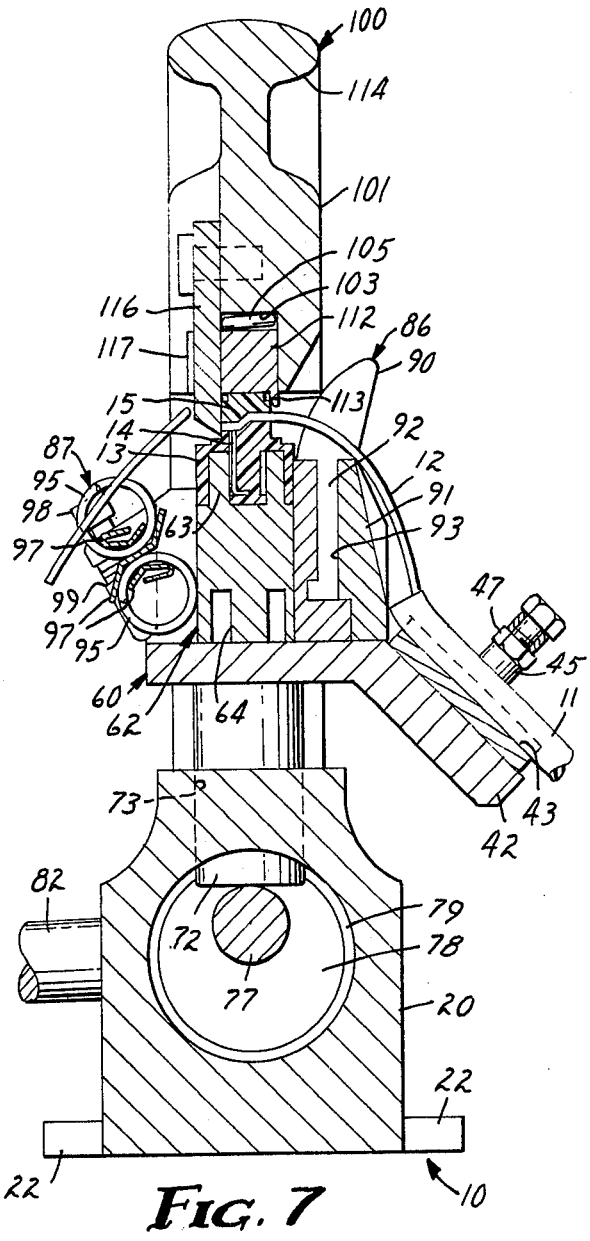
FIG. 7 shows the sectional view of FIGS. 5 and 6 with movable parts in the final position after cutting off free ends of the cable wires.

Referring to the drawings and particularly FIGS. 1–7 there is shown an embodiment of the invention and the manner in which it operates manually to attach wires to a cable connector. The cable terminating apparatus of the invention, generally designated 10 is employed for attaching a cable 11 of the type including multiple pairs of insulated wires 12 to a connector 13 including a plurality of spaced parallel contacts 14 and cover lid 15.

Cable terminating apparatus of the invention as shown in embodiment 10 of FIGS. 1–7 includes as parts a generally rectangular base 20 which supports cable arresting means, generally designated 40, means 80 for elevating the connector receiving station 60, and arm means 100 rotatable about the base to a position above the connector receiving station. Certain of these parts are subassemblies or subcombinations.

The base 20 shown in the embodiment of FIGS. 1–7 is combined with connector receiving station 60 and means 80 for raising the station. The means 80 as shown are mechanically activated but pneumatically or hydraulically operated means are contemplated as the equivalent as described in connection with FIGS. 8 through 10. Base 20 includes lugs 22 for attachment, if desired, to a work table or other such support.

Cable arresting means 40 is attached to the front of the connector receiving station for supporting cable 11 during operations thereon and is movable with the connector receiving station. In the embodiment shown, cable arresting means includes an inclined support plate 42 with grooves 43 and a rotatable manually activated clamping lever 44 locking by conventional lever means and urging the head 45 against the cable 11 into the selected grooves 43. The head 45 is provided with an adjustable face 46 threaded into the base and with locking nut 47. Grooves 43 are used alternatively for male or female connectors and are coded so that orientation of wires 12 during connection is optimized.

In addition to the cable arresting means 40 the connector receiving station 60 which is generally rectangular shape, is provided on the upper side with channel 61 for receiving reversible hermaphrodite receptacle 62 for a connector 13. The receptacle is shown enlarged in FIG. 2 and is seen to possess end tabs 67, a male recess 63 for reception of a female connector and female recess 64 for reception of a male connector and two vertical cylindrical holes 65 and 66 of larger 65 and smaller 66 diameter, with bevelled openings. The bevelled openings are not necessary but facilitate engagement of receptacle 62 in channel 61 with corresponding cylindrical posts (68) and 69 attached in channel 61 by screws 70. The differences in sizes of post 68 and 69 assures proper orientation of receptacle 62. The under side of receiving station 60 is attached by screws 71 to two cylindrical plungers 72 of which one is shown in the breakaway of FIG. 1. Plungers 72 extend through holes 73 in base 20.

Connector receiving station 60 is movably attached in channel 61 of base 20 by spring return 74 connected to suitable means 75 in the bottom of channel 61 and passing through hole 76 in base 20 and fastened to eccentric cam rod 77 eccentrically mounted, suitably in a hole 81 in bearing cams 78 which is bushed with bushings 79 in the ends of base 20. The tension in spring return 74 is sufficient to urge connector receiving station 60 toward base 20 but movable with respect thereto by action of cam rod 77 against plungers 72 as bearing cam 78 is rotated by handle 82 fastened by set screws 83 in holes 84 through bearing cam 78.

Connector receiving station 60 further includes first comb means 86 on the front of the apparatus for indexing pairs of insulated wires 12 and second comb means 87 for indexing individual wires after passing through the connector position. First comb means 86 in the embodiment of the drawings having tongues 85 at the ends fitting grooves 88 in connector receiving station 60, includes 25 uniformly spaced apart teeth 90 set by a convenient means in comb support 91 such as by roots 92 engaging grooves 93 in comb support 91. Second comb means 87 is conveniently two coils of wire 95 with stiffening means between and within the coil along one side which stiffening means is extended to be fastened by screws 98 in notches 99 on connector receiving station 60.

Arm means 100 includes arm 101 of a general U-shape having finger grip recess 114 in the base of the arm 101 rotatably mounted on projections 102 of bearing cams 78 with bushing 104 by means of arm cap 106 bolted to arm 101 by bolts 108. Arm 101 includes click stop 110 operating against suitable indentations 109 in base 20, anvil means or crimping bar 112 secured by screws 115 and movable in recess 103 against spring loads 105 set in cylindrical cavities 107. Guillotine blade 116 is attached to arm 101 and fits between guides 117 attached to crimping bar 112 and movable therewith. The contacting surface of crimping bar 112 is profiled 113 for proper contact with the lid 15 of connector 13.

In use the cable terminating apparatus of the invention may conveniently be attached to a work surface such as a work bench by bolts or screws in lugs 22. The apparatus is then in the loading position shown in FIGS. 3 and 4 and is loaded as shown in the sectional drawing of FIG. 5 with connector 13 in the receptacle 62. Cable 11 held by cable arresting means 40 and wires 12 are separated into pairs in first comb 86 according to the sequence desired for the connector. It is convenient to color code comb means 86 by coloring teeth in accordance with a prearranged plan. The pairs of wires are then placed across the connector and the extra portion is secured in second comb means 87. After all the pairs have been so arranged, lid 15 is placed in position on connector 13 and urged into contact sufficiently so that arm means 100 can be brought into vertical position above the connector receiving station and locked by click stops 110 in FIGS. 6 and 7. In this position crimping bar 112 is directly above cover or lid 15 and profiling 113 is positioned to engage cover or lid 15. The final operation is to rotate handle 80 through 180° from the open position of FIG. 5 through the intermediate position of FIG. 6 to the final position of FIG. 7. This moves cam rod 77 from a low position to a high position which acting against plungers 72 raises connector 13 with respect to cover or lid 15 until firm connection is made and then further raises the connector assembly against knife blade 116 which cuts wires 12 flush with the surface of the connector assembly. The handle 82 and arm means 100 are then returned to the open position, and the terminated cable removed. Short wire pieces remaining in second comb means 87 are gathered together for disposal and the apparatus is ready for reuse.

Figure 8:
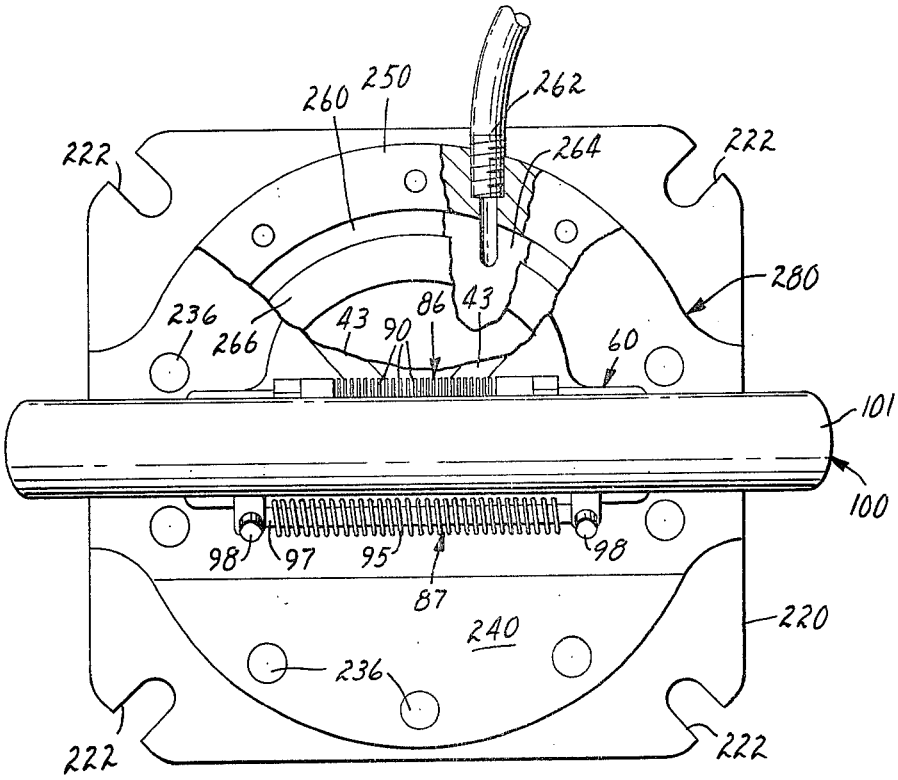
FIG. 8 is a top view of another embodiment of the invention which is prematurely activated.
Figure 9:
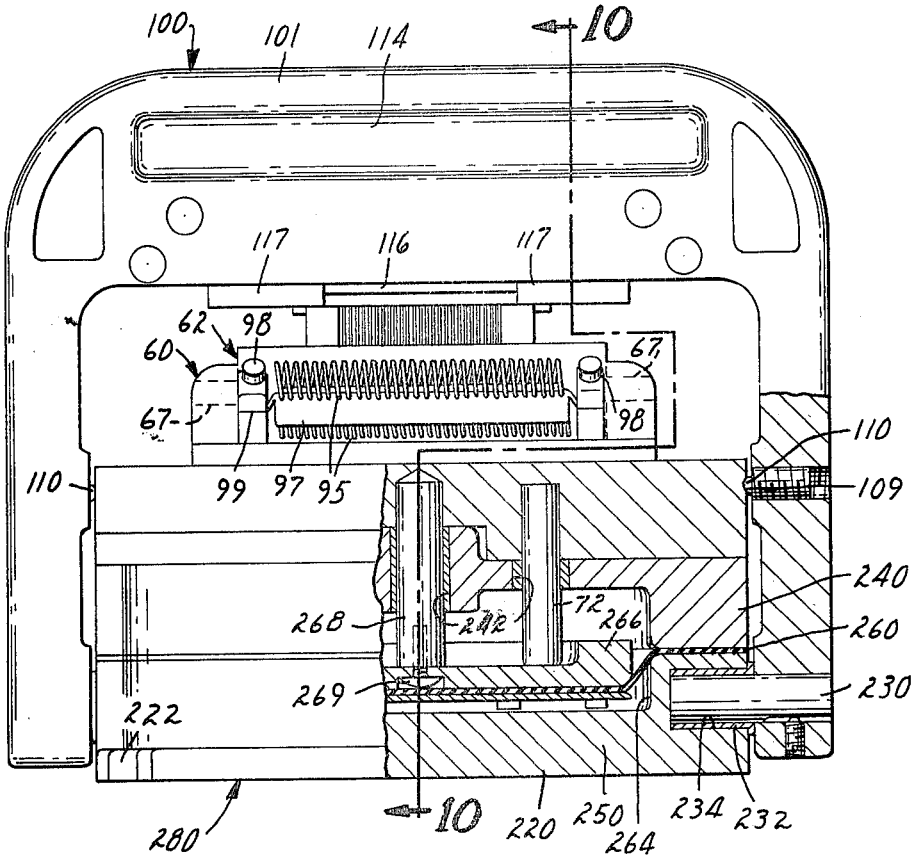
FIG. 9 is a rear view partly broken away of the embodiment of FIG. 8.
Figure 10:
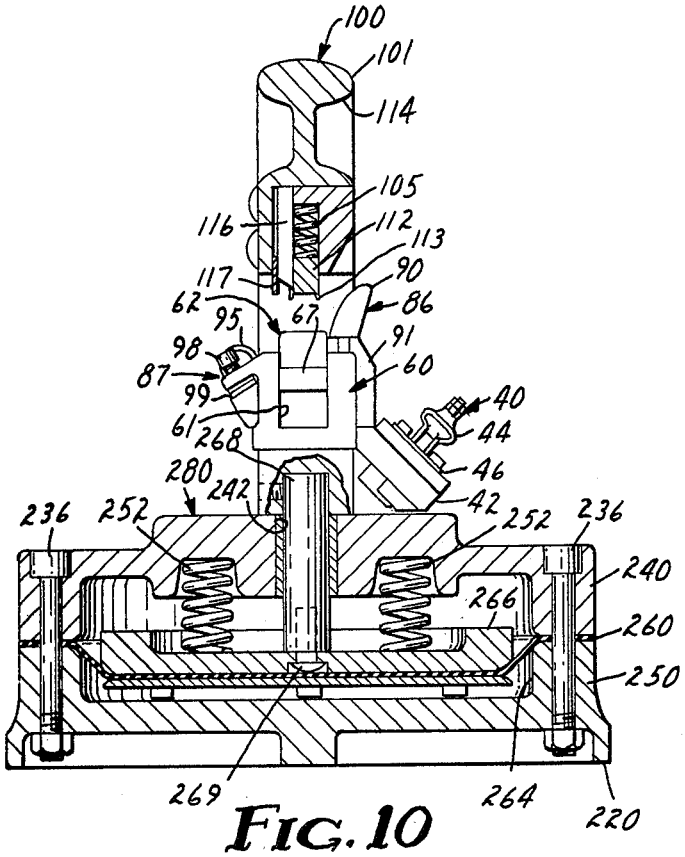
FIG. 10 is sectional view taken along line 10—10.

Reference is now made to FIGS. 8 through 10 showing a pneumatically operated embodiment of the invention. In many respects this embodiment is substantially identical to the cam-operated embodiment described above in connection with FIGS. 1 through 7 but differs particularly in having no handle and having a base adapted to include pneumatic means for elevating the connector receiving station. Parts having substantially the same function and structure as in FIGS. 1–7 are given the same indicia numbers as in the above descriptions in order that differences may be evident.

The embodiment of FIGS. 8–10 includes a rectangular base 220 supporting cable arresting means 40 attached to connector receiving station 60 and pneumatic means 280 for elevating the connector receiving stations and arm means 100 rotatable about the base to a position above the connector receiving station 60. Base 220 includes slots 222 for attachment to a work bench as it is contemplated that this embodiment will be particularly valuable in manufacturing operations.

Cable arresting means 40 and its operation is as described above and accordingly it is not shown in great detail in FIGS. 8–10. In FIG. 8, support plate 42 is broken away (leaving portions of grooves 43) to permit better representation of the structure of base 220.

Arm means 100 is also substantially identical to the arm means in FIGS. 1–7 and as described above except that it is rotatably mounted in hole 234 of base 220 by shaft 230 with bushing 232 and extends downward over guillotine blade 116 further as will be seen in FIGS. 9 and 10. Some details which are identical to those of FIGS. 1–7 are not shown.

Connector receiving station 60 is substantially identical to that of FIGS. 1–7 and the descriptions there given apply to the connector receiving station of FIGS. 8–10 including parts having the same indicia.

Base 220 is composed of upper shell 240 and lower shell 250 joined by bolts 236 and holding diaphragm 260 between them. Upper shell 240 is shown broken away in FIG. 8 to show air inlet and exhaust means 262 and pneumatic chamber 264 in lower shell 250. Diaphragm 260 is attached to plate 266 which latter is attached to connector receiving station support 268 by screw 269. Upward forces of plate 266 from introduction of air into pneumatic chamber 264 are transferred to connector receiving station 60 by support 268 and plunger rods 72 operating through holes 242 in upper shell 240. Plate 266 and diaphragm 260 are held in the open position by action of springs 252 acting between upper shell 240 and plate 266.

It will be evident that introduction of air (or other gas or liquid) into pneumatic chamber 264 will result in forcing plate 266 upward, compressing springs 252 and urging connector receiving station 60 upward towards crimping bar 112 resulting in action as described above in connection with motion of the handle of the cam-operated embodiment.

Referring now to the embodiment of the invention 30 as shown in FIGS. 11–14, parts as shown in FIGS. 1, 3, 4, 6 and 7 are given the same numbers because this embodiment involves essentially replacement of the connector receiving station 60 and anvil means, i.e., crimping bar 112 and elimination of the cutting means, i.e., guillotine blade 116 of those figures.

In the embodiment 30 of FIGS. 11–14, base 20 is combined with cross-connect block receiving support 160 and means 80 for raising the support. Means 80 as shown are mechanically activated but may also be pneumatically or hydraulically operated as described in connection with FIGS. 8 through 10. Base 20 includes lugs 22 for attachment to a support such as a work table.

Cross-connect block receiving support 160 is provided with positioning pins 162 (only one visible, in FIG. 12) for positioning lid 164 of 25-pair cross-connect base 166 as described in application U.S. Pat. No. 3,708,779 of D. J. Enright, R. D. Kahabka and D. F. Miller. Cross-connect block receiving support 160 is further provided with plungers 72 attached by any convenient means as by machine screws (not shown). Cross-connect block receiving support 160 is interchangeable with connector receiving station 60 and is held in position as described above for that station. Because the internal structure and mode of elevation, etc. are the same as for the embodiment of FIGS. 1–7, they are not shown in detail in FIGS. 11–14 and only incidentally in FIGS. 13 and 14.

Figure 11:
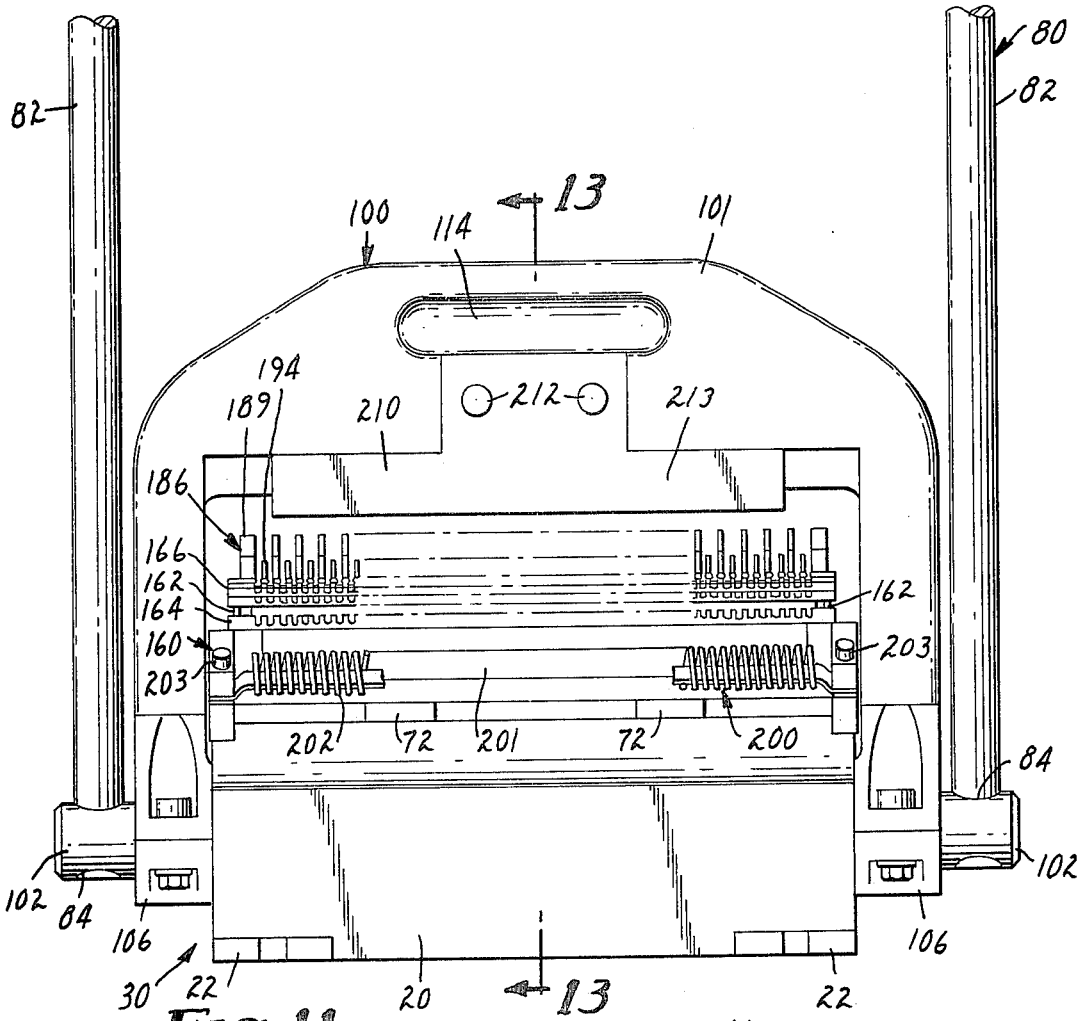
FIG. 11 is a front elevation view in intermediate position of relatively movable parts of another embodiment of the invention for attaching connectors to multipair cables.
Figure 12:
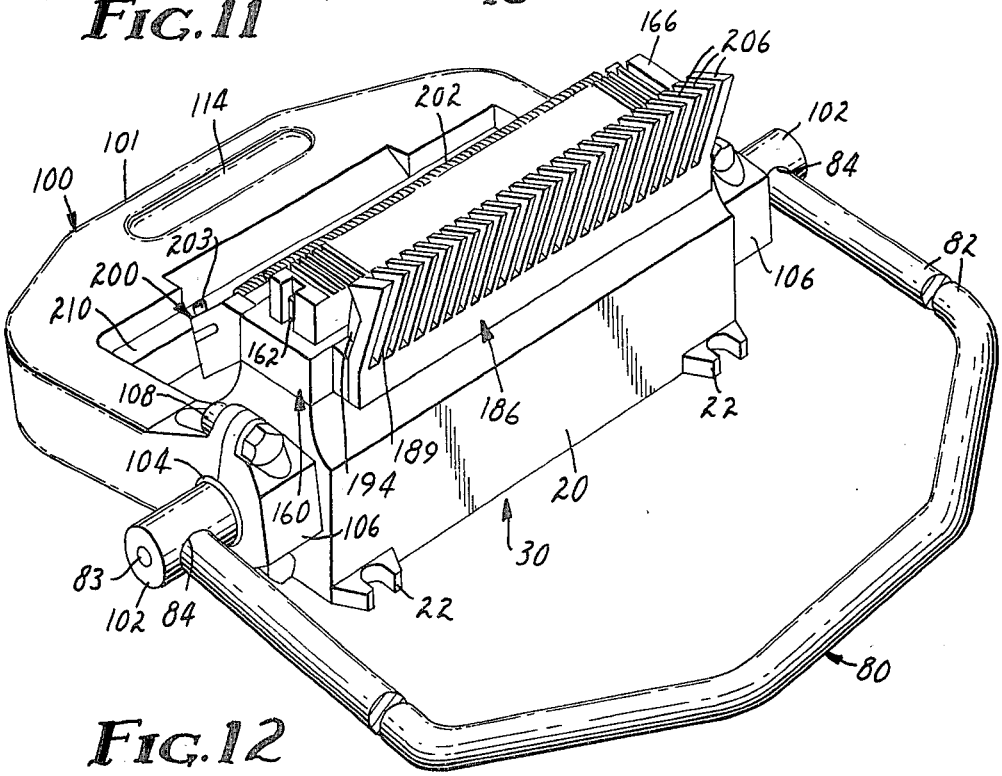
FIG. 12 is a perspective view of the front of embodiment of FIG. 11 in an open position.
Figure 13:
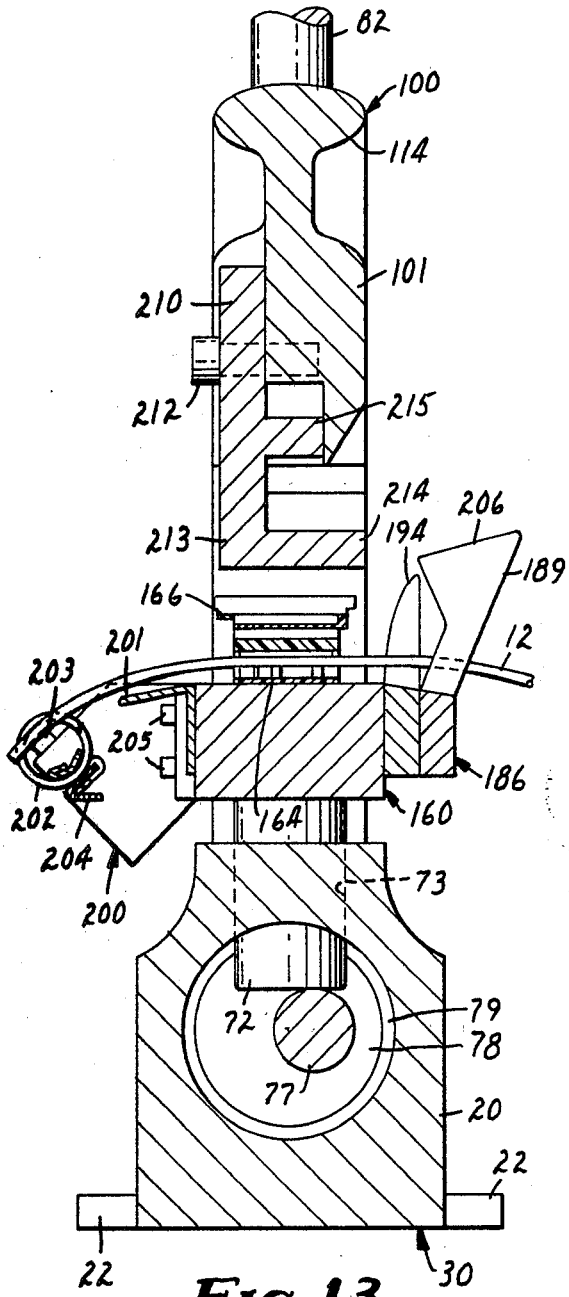
FIG. 13 is an enlarged sectional view taken along line 13—13 of FIG. 11 with movable parts in an intermediate position and wires partly connected.
Figure 14:
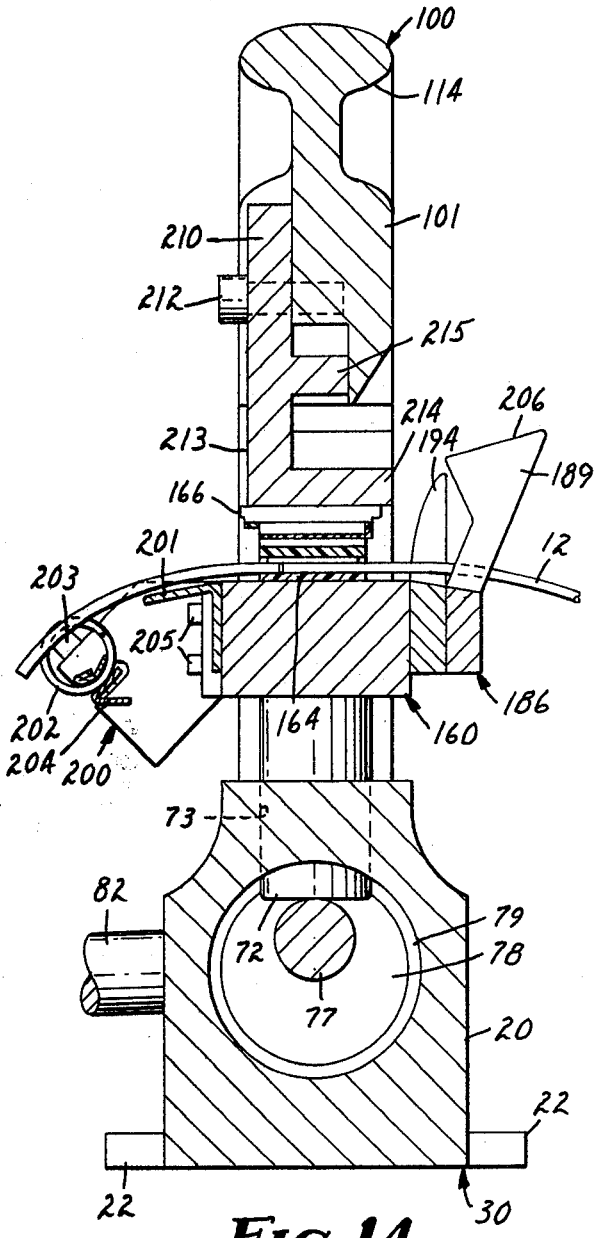
FIG. 14 shows the sectional view of FIG. 13 with movable parts in the final position and with wires cut by blades within the connector lid.

Attached to cross-connect block receiving support 160 are first comb means 186, separating wires 12, composed of two combs 189 and 194 positioned with teeth alternating as seen in FIG. 11, a second comb means 200 holding wires 12 after positioning in cross-connect block lid 164 and wire support 201. Wire support 201 substantially bridges the space between cross-connect base receiving support 160 and spring 202 of second comb means 200, attached at its ends by screws 203 together with backing plate 204. Second comb means 200 is attached to cross-connect block receiving support 160 by convenient means such as screws 205. The teeth of comb 189 are actually flattened at the end 206 and extended as shown in FIGS. 13 and 14 and the outer end of each 206 is conveniently provided with an interupted longitudinal depression in which colored coding corresponding to wire pairs is marked.

Arm means 100 is similar in general to the same part of the embodiment of FIGS. 1 to 7 except that anvil means 210 is not movable in arm means 100 but is fixed in position by bolts 212 and includes back plate 213, anvil plate 214 and spacer plate 215. The spring load 105 of FIGS. 1–7 is unnecessary for the anvil means 210 of FIGS. 11–14.

Figure 15:
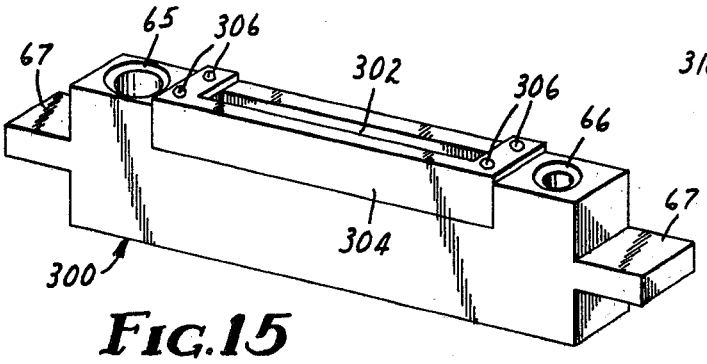
FIG. 15 is a perspective view of an interchangeable connector receptacle of a different outline from that of FIG. 2 and adapted for insertion of other receptacle contours.
Figure 16:
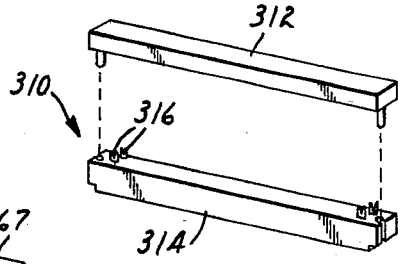
FIG. 16 is a perspective view of the connector and lid for connection using the receptacle of FIG. 15.

In FIG. 15 is shown in perspective an enlarged receptacle 300 (alternative to receptacle 62 for insertion in channel 61 of FIGS. 1–7) having cavity 302 defined by inset 304 secured in position by screws 306. This receptacle is particularly intended for use with connector 310 shown in perspective in FIG. 16. Connector 310 consists of lid 312 and base 314 which is provided with wire clips 316.

What is claimed is:

1. Apparatus for attachment of a connector to a multipair cable comprising:

a base having a longitudinal axis, a connector receiving station on said base having a supply side and a product side comprising a receptacle for a connector, first comb means on said supply side of said station for positioning and indexing pairs of a multipair cable and second comb means on the product side of said station for positioning and holding members of said pairs transverse of said station, arm means comprising anvil means, said arm means being rotatable about the said axis of said base from a horizontal position to position said anvil means immediately above said connector receiving station in position to contact a connector in said receptacle of said connector receiving station when said connector is covered and said connector receiving station is elevated with respect to said base, and means in said base for elevating said connector receiving station with respect to said base when said anvil means is positioned over said connector receiving station thereby causing the cable pairs to be inserted into the connector.

2. Apparatus according to claim 1 additionally comprising cable arresting means on the base for positioning a multipair cable.

3. Apparatus according to claim 1 having spring-loaded anvil means.

4. Apparatus according to claim 3 comprising cutting means adjacent the anvil means and on the same side of the arm means as the second comb means on the connector receiving station when the arm means is rotated into position above the connector receiving station.

5. Apparatus according to claim 1 wherein the means in the base for elevating the connector receiving station is pneumatically operated.

6. Apparatus according to claim 1 wherein the means in the base for elevating the connector receiving station is cam operated.

7. Apparatus according to claim 1 wherein the first comb means is color coded to a predetermined number of groups of comb teeth.

* * * * *